United States Patent [19]

Swerbinsky

[11] Patent Number: 4,653,819

[45] Date of Patent: Mar. 31, 1987

[54] REFRIGERATOR CABINET AND GASKET CONSTRUCTION

[75] Inventor: Leo Swerbinsky, Louisville, Ky.

[73] Assignee: General Electric Company, Louisville, Ky.

[21] Appl. No.: 739,351

[22] Filed: May 30, 1985

[51] Int. Cl.[4] ..... A47B 81/00

[52] U.S. Cl. ..... 312/296; 49/478; 49/487; 312/214

[58] Field of Search ..... 312/296, 214, 116, 236; 49/478, 487, 489

[56] References Cited

U.S. PATENT DOCUMENTS

| | | | |
|---|---|---|---|
| 2,659,115 | 11/1953 | Anderson et al. | 49/478 X |
| 2,914,819 | 12/1959 | Janos | 49/478 |
| 3,048,902 | 8/1962 | Hastings et al. | 49/478 X |
| 3,078,134 | 6/1961 | Haynes, Jr. . | |
| 3,132,386 | 2/1962 | Swaneck, Jr. . | |
| 3,221,375 | 12/1965 | Lewis et al. | 312/296 X |
| 3,359,053 | 12/1967 | Hagendoorn . | |
| 3,378,957 | 4/1968 | Frehse | 49/478 X |
| 3,461,610 | 8/1969 | Peters et al. | 49/478 |
| 3,469,349 | 9/1969 | Multer | 49/478 |
| 3,882,637 | 5/1975 | Lindenschmidt | 49/489 X |
| 3,942,853 | 3/1976 | Grimm et al. | 312/296 |
| 4,226,489 | 10/1980 | Haag | 312/296 |
| 4,469,383 | 9/1984 | Losert | 49/487 X |

FOREIGN PATENT DOCUMENTS

| | | | |
|---|---|---|---|
| 927691 | 5/1955 | Fed. Rep. of Germany | 312/296 |
| 2816315 | 2/1979 | Fed. Rep. of Germany | 312/296 |
| 78472 | 7/1955 | Netherlands | 312/296 |
| 2130351A | 5/1984 | United Kingdom | 312/214 |

*Primary Examiner*—Kenneth J. Dorner
*Assistant Examiner*—Thomas A. Rendos
*Attorney, Agent, or Firm*—Frederick P. Weidner; Radford M. Reams

[57] ABSTRACT

A refrigerator cabinet including a storage compartment having an access opening surrounded by a face portion of magnetic material. A door is hingedly mounted on said cabinet for closing and opening said access opening. The door comprises an outer panel and an inner panel, said panels having thermal insulation therebetween. There is provided a sealing gasket of resilient material mounted on the door adjacent the peripheral edges and including a base portion and a cabinet engaging portion integrally joined to the base portion and including a magnet to provide the sole means for holding the door in a closed position. The base portion has a web parallel to the door and also has an upwardly extending rigid projection with a terminal end intermediate the ends of the web. The cabinet engaging portion has a web spaced from and resiliently joined to both ends of the base portion and having the magnet retained in a cavity at the front end of the cabinet engaging portion and a support member having a top, bottom, front and rear wall located behind the magnet cavity. The support member extends below and forward of the terminal end of the base portion upstanding projection when the door is in its open position and spaced from the base portion upstanding projection a distance such that upon closing the door the rear wall of the support member may engage the rigid projection and urge the magnetic means retained in the cavity across of the face portion.

8 Claims, 4 Drawing Figures

1
2
3
4
6
7
8
9
10
11
12
13
16
17
18
20
21
22
25
28
30
32
34
36
38
40
42
50
60
65
66
68
70

1
2
3
4
6
7
8
9
10
16
17
18
20
21
22
25
28
30
32
34
36
38
40
42
50
60
65
66
68
70

REFRIGERATOR CABINET AND GASKET CONSTRUCTION

BACKGROUND OF THE INVENTION

The present invention relates to refrigerator and freezer cabinet construction and is more particularly concerned with a cabinet including an improved magnetic gasket construction for preventing sweating of the cabinet door in the vicinity of the sealing gasket and provides easy assembly of the door.

A well known type of magnetic gasket designed not only to seal the space between the door and the cabinet face but also to maintain the door in a closed position by attraction of a magnetic means carried by the gasket with a magnetic metallic area on the face of the cabinet comprises a base portion including means for securing one longitudinal edge of the base portion to the door and a tubular portion containing the magnetic means. The gasket is an extruded resilient material such as rubber, polyvinylchloride or the like. The flexibility or resiliency of various portions of the gasket is controlled by varying the cross-sectional thicknesses thereof in order that each portion may perform the desired function or functions. For example, the base portion which is secured along its outer edge to the door assembly, must be sufficiently thick and rigid so that its inner free edge is normally in engagement with the door surface and maintains an insulating dead air space beneath the gasket base portion when the door is in a closed position. However, the gasket must be sufficiently flexible so that it can be folded back during assembly of the door and gasket to provide access to the fastening or anchoring means employed to secure the one edge of the gasket to the door. A typical refrigerator cabinet construction and gasket to solve this problem is described in U.S. Pat. Nos. 3,359,053 and 4,469,383, assigned to the same assignee as the present invention.

Another problem in connection with flexible door gaskets using a magnetic means for maintaining the door in its closed position is that on the hinge side of the door when the door is being closed the magnetic means is attracted to the magnetic portion of the cabinet and in effect "reaches out" to attach itself to the magnetic portion of the cabinet just before the door is completely closed. Upon continuing closing the door there is a gasket scrubbing action which means that only the edge of the gasket portion containing the magnetic means contacts the magnetic material of the outer refrigerator case and as the door continues to be closed the magnet stays in place but the gasket becomes distorted. This distortion prevents adequate sealing characteristics of the gasket to the components of the door and outer case which are to be sealed. The inadequate sealing can cause undesirable heat transfer through the area of sealing to the outer door panel resulting in sweating on the outer surface of the door and cabinet. In addition the distortion of the gasket as a result of frequent door closings will detrimentally effect the life of the gasket.

By this invention, there is provided a refrigerator cabinet which includes a gasket configuration which overcomes the above-mentioned gasket sealing problems.

SUMMARY OF THE INVENTION

A refrigerator cabinet including a storage compartment having an access opening surrounded by a face portion comprising an area composed of magnetic material. A door is hingedly mounted on said cabinet along one edge thereof for closing and opening the access opening, said door comprising an outer metal panel having an inwardly turned flange extending about the periphery thereof and a plastic inner panel, said panels having thermal insulation therebetween. There is a sealing gasket of resilient material mounted on the door adjacent the peripheral edges thereof and includes a base portion and a cabinet engaging portion integrally joined to the base portion and including a magnetic means attracted to said area of magnetic material and providing the sole means for holding the door in a closed position.

The base portion of the sealing gasket has a web parallel to the door having at one end a downwardly extending rear projection spaced from the door and the other end having a downwardly extending front member terminating with an in turned portion that is secured to the door, said web having an upwardly extending rigid projection with a terminal end intermediate the ends of the web.

The cabinet engaging portion of the sealing gasket is spaced from the base portion and has a web resiliently joined to both ends of the base portion and having the magnetic means retained in a cavity at the front end of the cabinet engaging portion and a support member having a top, bottom, rear and front wall located behind the magnetic means cavity, said support member extending below and forward of the terminal end of the base portion upstanding projection when the door is in its open position and spaced from the base portion upstanding projection a distance such that upon closing the door the rear wall of the support member may engage the rigid projection and urge the magnetic means retained in the cavity across the area of magnetic material of the face portion.

DESCRIPTION OF THE PREFERRED EMBODIMENT

Figure 1:
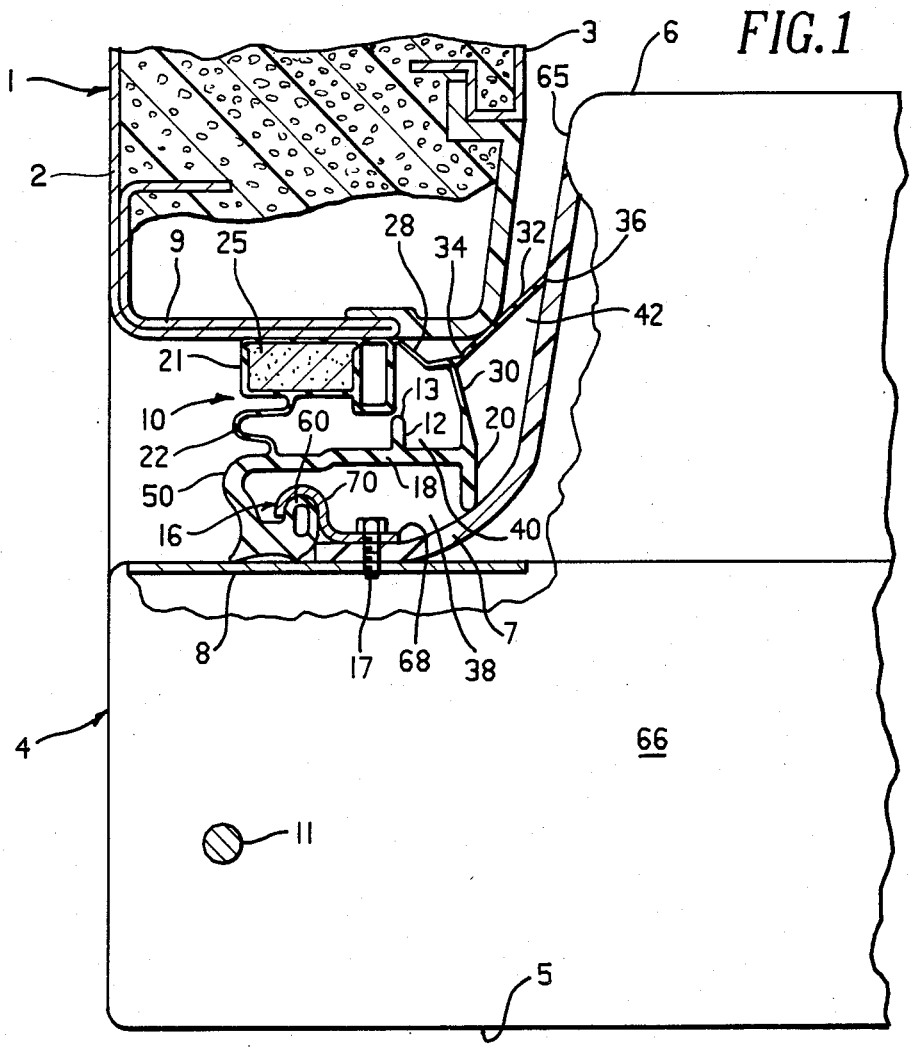
FIG. 1 is a lateral cross-section view through a portion of a refrigerator cabinet and the magnetic gasket embodying the present invention.
Figure 2:
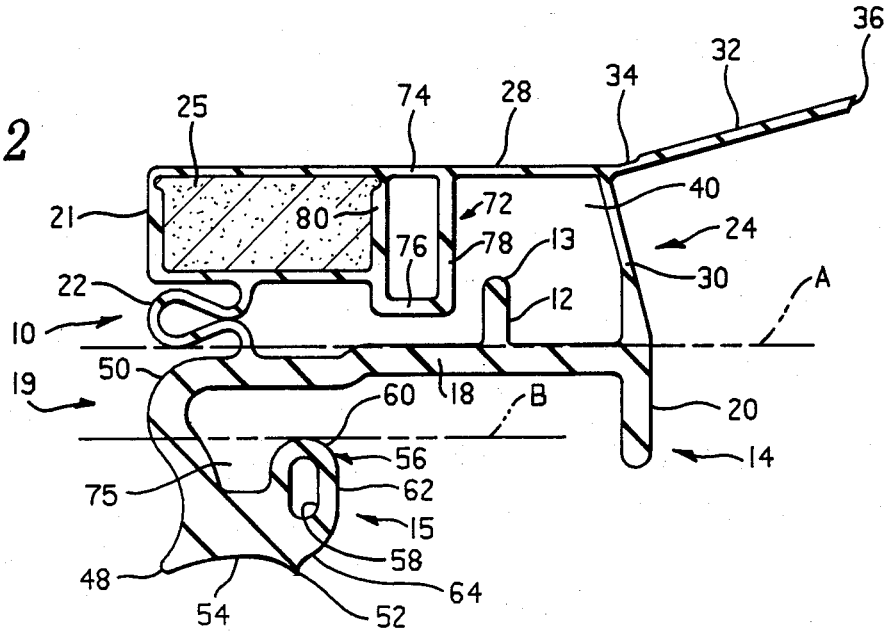
FIG. 2 is a lateral cross-section view of the magnetic gasket utilized in the present invention in its free or "as extruded" configuration.

Referring to FIGS. 1 and 2 of the drawing in particular, there is shown a refrigerator including a cabinet member 1 comprising an outer metal shell 2 and a plastic breaker of liner 3, the liner forming a storage compartment within the cabinet. A door 4 for closing the access opening to the storage compartment is hingedly supported along one vertical edge thereof by means of hinges (not shown) having a pivot point 11 about which the door pivots. The door comprises an outer panel 5 usually of sheet metal and an inner panel 6 usually of plastic sheet material. Inner panel 6 has a flange with a peripheral edge portion 7 which overlaps a portion of an inwardly extending flange 8 on the outer panel 5. The space between the face of the cabinet as represented by an inwardly extending flange 9 on the cabinet shell 2 and the door is sealed and held in a closed position by means of a magnetic gasket generally indicated by the numeral 10.

The gasket 10 comprising a resilient material such as rubber, polyvinylchloride or the like includes a base portion generally indicated in FIG. 2 as 14 and is that portion of gasket 10 below line A and a cabinet engaging portion generally indicated as 24, which is that portion above line A. The base portion 14 has a first section generally designated 15 and is that section below line B in FIG. 2 and a second section generally designated 19 between lines A and B. The first section 15 of the base portion 14 is secured to the flange 8 by means of a retainer strip 16 extending substantially the full length of the gasket. The retainer strip 16 is secured directly to the flange 8 by means of a plurality of screw fasteners 17 extending through the retainer strip, the peripheral edge portion 7, and flange 8 to join those elements together. It will be noted that the first section 15 of the gasket 10 comprises the sole means for securing the gasket to the door. The base portion 14 is of generally rectangular cross-section, as viewed in FIG. 1. There is a front curved member 50, a downwardly extending rear member 20 with a horizontal web member 18 between members 50 and 20. These members together with the door 4 form a rectangular cavity or dead air space 38 when the gasket is attached to the door. It will be noted that the downwardly entending projection 20 thereof is in engagement with the inner door panel 6 when fully assembled. The base has an upwardly extending relatively rigid projection with a terminal end 13 intermediate the ends of the web 18. The front curved member 50 is sufficiently flexible so that the portion of gasket 10 above line B can be folded or flexed away from the inner surface of the door during assembly of the refrigerator door and gasket in order to provide access for driving the fasteners 17.

The cabinet engaging portion 24 of gasket 10 has a rectangular cavity 21 secured at the front end to the base portion 14 by a U-shaped structure 22 which provides limited movement between the cavity portion 21 and the base portion 14. A magnet 25 of the well know type comprising metallic magnetic particles embedded in the strip of plastic material is contained within the cavity 21 which registers with the magnetic metal face portion or flange 9 of the cabinet, the magnetic attraction between the magnet 25 and the flange 9 serving as the sole means for holding the door in its closed position (FIG. 1). Located behind the magnetic means cavity 21 is a support member 72 in the shape of a vertical rectangle having a top 74, bottom 76, rear 78 and front 80 wall which support member 72 extends below and forward of the terminal end 13 of the base portion upstanding projection 12 (FIG. 2) when the door is in its open position and spaced from the base portion upstanding projection a distance such that upon closing the door the rear wall 78 of the support member 72 may engage the rigid projection 12 and move the magnetic means retained in the cavity across the area of magnetic material of the face portion 9. The support member 72 is not connected to the bare portion 14 to allow the cabinet engaging portion to reach out toward the magnetic material of the face portion due to magnetic attraction between the magnet 25 and the magnetic material when the door is near its fully closed position.

The cabinet engaging portion 24 of gasket 10 is of a relatively thin cross-section as compared with the base portion 14 and has a first leg 28 parallel to and spaced from the base portion web member 18 and a second leg 30 joining the first leg 28 and the base portion web member 18. The U-shaped structure 22 joins the rectangular cavity 21 to the base portion 14 at the front therof, and legs 28 and 30 join the rear portion of the rectangular cavity 21 to the base portion 14. With this arrangement, there is formed a rectangular dead air or insulating space 40. There is also provided a flexible flap 32 which is joined to the cabinet engaging portion 24 at the junction 34 of legs 28 and 30 and has a free end 36 that is in contact with the inner door panel 6 as seen in FIG. 1. This arrangement forms another dead air or insulating space 42 (FIG. 1). With this gasket arrangement, it will be noted that there is in effect three separate dead air insulating spaces 38, 40 and 42 provided by cooperation of the gasket 10 with the door 4 and the cabinet 1. These dead air spaces provide for good thermal insulation to prevent the passage of air between the inside of the cabinet and the outside surrounding ambient air.

With particular reference to FIG. 2, the "as extruded" gasket has at the forward end of the base portion 14 a first section 15 which has a front seal 48 which projects downwardly and outwardly from the curved front member 50 and there is a rear seal 52 spaced from the front seal 48. The first section 15 also has an upwardly depending hollow member 56 located above the rear seal 52 and has a cavity 58, a dome-shaped upper wall 60 and a rear vertical surface 62. There is a curved surface 64 connecting the rear seal 52 and the rear vertical surface 62 of the hollow member 56. The hollow member 56 is spaced rearward of the front curved member 50, thus providing a space 75 therebetween. Utilization of the structural arrangement described above will now be discussed.

In constructing the refrigerator door 4, the outer metal panel 5 is formed to provide an inwardly turned flange 8. The inner door panel 6 is formed of plastic material and has a flange with a peripheral edge portion 7 with a terminal end 11 and a portion 65 directed upwardly away from the flange. The peripheral edge portion 7 of the inner door panel is placed on a portion of the inwardly turned flange 8 of the outer door panel. Insulation material 66 is placed between the outer door panel and inner door panel either before attaching one panel to the other or afterwards. The retainer strip 16 has a flat section 68 and an upwardly curved section 70, the inside dimension of which conforms with the dome-shaped upper wall 60 of the hollow member 56. The flat section 68 is placed on the peripheral edge portion 7 of the inner door panel loosely; that is, the fasteners 17 are not tightened at first and this allows for the positioning of the base portion 14 of the sealing gasket under the retainer strip and specifically the hollow member 56. After insertion of the gasket in this manner, the portion of gasket 10 above line B of FIG. 2 is flexed upwardly away from the retainer strip to allow access to the fasteners 17. The fasteners are then tightened to secure the outer door panel, inner door panel, retainer strip and base portion of the sealing gasket together.

Figure 3:
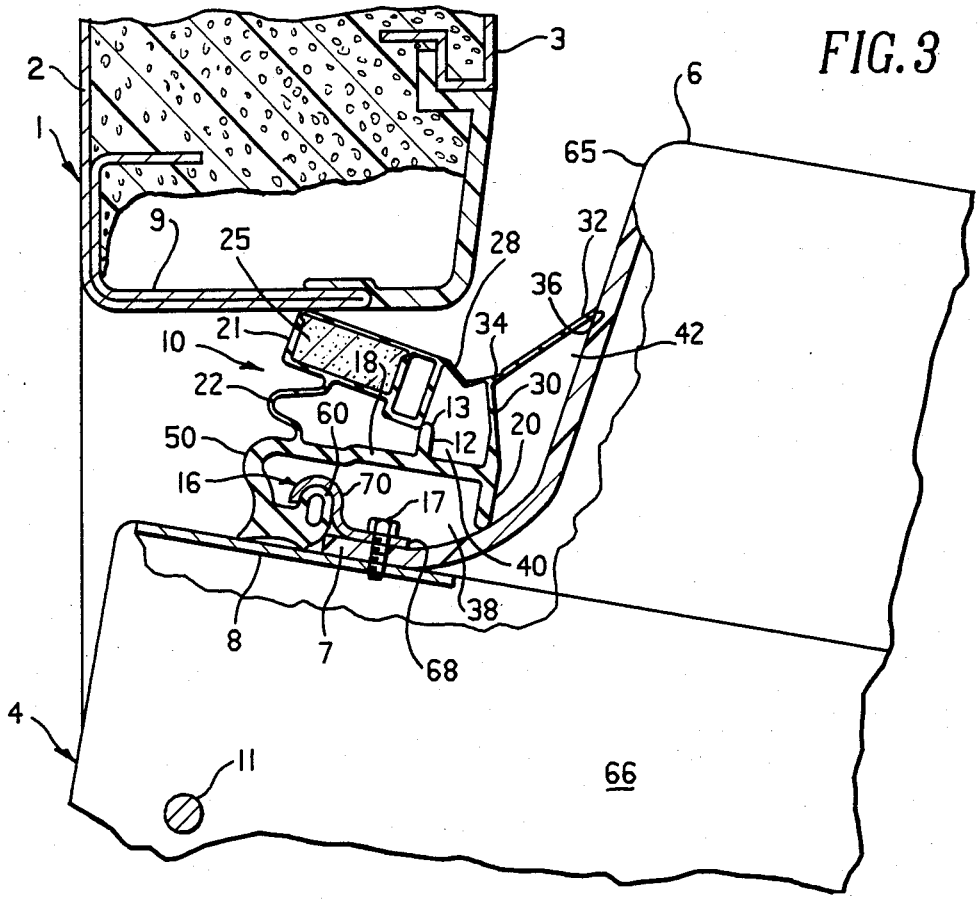
FIG. 3 is a lateral cross-section view through a portion of a refrigerator door cabinet and the magnetic gasket embodying the present invention and showing partial closure of the refrigerator door.
Figure 4:
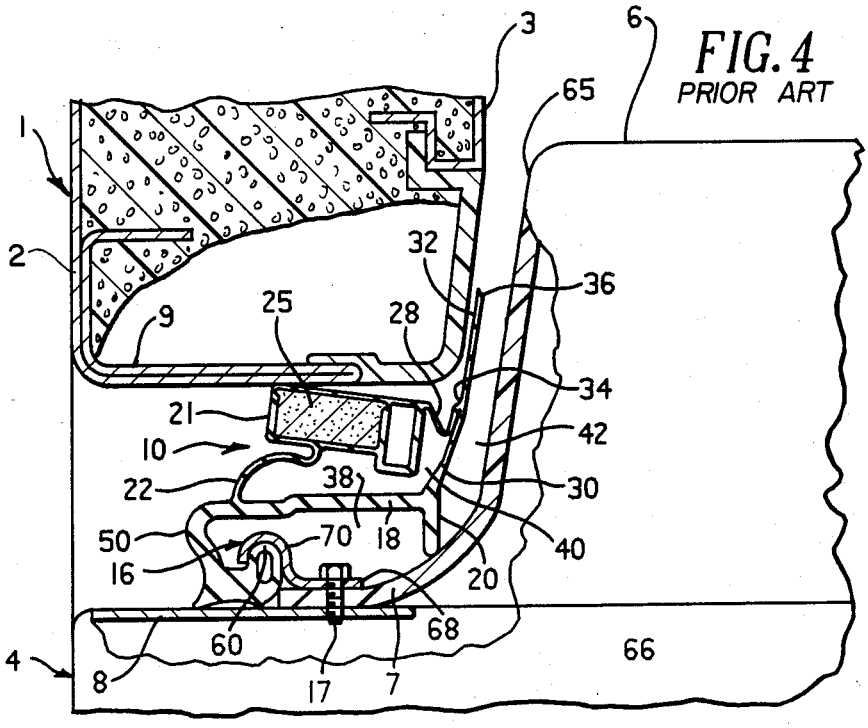
FIG. 4 PRIOR ART
FIG. 4 is a lateral cross-sectional view similar to that shown in FIG. 1 but embodying a prior art magnetic gasket seal to show the distortion of the gasket as a result of not employing the gasket configuration of the present invention.

With reference to FIG. 4 there is shown a prior art gasket mounted to the door 4. The portion of the door gasket located on the hinge side of the door is subject to a scrubbing action upon closing of the door wherein during partial closing the cabinet engaging portion 24 carrying in the rectangular cavity 21 the magnet 25 is attracted and moves toward the magnetic material of the inwardly extending flange face portion 9 with its forward edge making contact with that face portion. The position just described is as shown in FIG. 3. Without utilizing the gasket configuration of applicant's present invention, upon continued closing of the door 4 to the position shown in FIG. 4 the gasket is only making slight contact with the face portion 9 and therefore there is very little sealing engagement between the cabinet engaging portion 24 and the flange face portion 9. Due to the distortion of the gasket not only is there leakage between those two members but also the insulating space 42 as shown in FIG. 1 is no longer effective. As a result of the gasket distortion caused by the scrubbing action of the door relative to the flange face portion 9 there is undesirable heat transfer through this area to the outer door panel which results in sweating on the outer surface of the door and outer case. Moreover, the continued opening and closing of the door will cause premature failure of the gasket in this area. By applicant's invention as shown in particularly in FIGS. 1 and 3 when the door is near its completely closed position and the cabinet engaging portion 24 does reach out as a result of magnetic attraction between the magnet 25 and the magnetic inwardly extending flange face portion 9 the gasket assumes the position as shown in FIG. 3. However with continued closing of the door the support member 72 will abut the upwardly extending rigid projection 12 and will force the cabinet engaging portion 24 along the face portion as a result of continued closing movement of the door thereby urging it into its correct sealing position as shown in FIG. 1 thus overcoming the problems associated with the prior art gasket shown in FIG. 4.

While, in accordance with the patents statute, there has been described what at present is considered to be the preferred embodiment of the invention, it will be obvious skilled in the art that various changes and modifications may be made thereto without departing from the invention. It is, therefore, intended by the appended claims to cover all such changes and modifications as fall within the true spirit and scope of the invention.

What is claimed is:

1. A refrigerator cabinet comprising:

a storage compartment having an access opening surrounded by a face portion comprising an area composed of magnetic material;

a door hingedly mounted on said cabinet along one edge thereof for closing and opening said access opening, said door comprising an outer panel having an inwardly turned flange extending about the periphery thereof and an inner panel, said panels having thermal insulation therebetween;

a sealing gasket of resilient material mounted on said door adjacent the peripheral edges thereof and including a base portion and a cabinet engaging portion integrally joined to said base portion and including a magnetic means attracted to said face portion magnetic material and providing the sole means for holding the door in a closed position, the base portion having; a web parallel to the door end having at one end a downwardly extending rear projection spaced from the door and the other end having a downwardly extending front member terminating with an inturned portion that is secured to the door, said web having an upwardly extending rigid projection with a terminal end intermediate the ends of the web, the cabinet engaging portion being spaced from the base portion and having a web resiliently joined to both ends of the base portion and having the magnetic means retained in a cavity at the front end of the cabinet engaging portion and a support member having a top, bottom, rear and front wall located behind the magnetic means cavity, said support member extending below and forward of the terminal end of the base portion upstanding projection when the door is in its open position and spaced from the base portion upstanding projection a distance such that upon closing the door the rear wall of the support member may engage the projection and urge the magnetic means retained in the cavity across the area of magnetic material of the face portion.

2. The refrigerator cabinet of claim 1 wherein the magnetic means retaining cavity and the front wall of the support member are integral and form one wall.

3. The refrigerator cabinet of claim 1 wherein the cabinet engaging portion is of a relatively thin cross section as compared with said base portion.

4. The refrigerator cabinet of claim 1 wherein the inturned portion of the base portion is secured to the door by an elongated retainer member overlying the inturned portion having fasteners through the retainer member, the inner panel and inwardly turned flange of the outer door panel.

5. The refrigerator cabinet of claim 4 wherein the cabinet engaging portion is resiliently joined to the base portion at the front thereof and is movable from a first position covering the retainer member to a raised position uncovering the retainer member to allow access to the fasteners.

6. The refrigerator cabinet of claim 1 wherein the cavity retaining the magnetic means is rectangular and receives therein a strip of magnet material to provide the magnetic means.

7. The refrigerator cabinet of claim 6 wherein the rectangular cavity is joined at its front end to the base portion by a flexible u-shaped structure and at the rear end by a first leg parallel and spaced from the base portion and a second by joining the first leg and the base portion.

8. The refrigerator cabinet of claim 7 wherein the inner panel has a portion directed upwardly away from the flange and the cabinet engaging portion of the gasket has a flap extending from the junction of the second leg and first leg such that it contacts said upwardly directed portion of the inner panel.

* * * * *